US007490409B2

(12) United States Patent
Oh

(10) Patent No.: US 7,490,409 B2
(45) Date of Patent: Feb. 17, 2009

(54) HEAD MOVING TYPE ELECTRIC RAZOR

(76) Inventor: Tae-Jun Oh, Bupyeong6-ri, Jingeop-eup, Namyangju-shi, 472-864, Gyeonggi-do (KR)

( * ) Notice: Subject to any disclaimer, the term of this patent is extended or adjusted under 35 U.S.C. 154(b) by 26 days.

(21) Appl. No.: 11/565,800

(22) Filed: Dec. 1, 2006

(65) Prior Publication Data

US 2007/0124938 A1 Jun. 7, 2007

(30) Foreign Application Priority Data

Dec. 2, 2005 (KR) ..... 20-2005-0034047 U

(51) Int. Cl.
*B26B 19/02* (2006.01)

(52) U.S. Cl. ..... 30/43.92; 30/346.51; 30/527

(58) Field of Classification Search ..... 30/43.9, 30/43.92, 346.51, 527
See application file for complete search history.

(56) References Cited

U.S. PATENT DOCUMENTS 4,837,929 A * 6/1989 Tanahashi et al. ..... 30/43.92
5,551,154 A * 9/1996 Tanahashi et al. ..... 30/43.92
5,706,582 A * 1/1998 Hosokawa et al. ..... 30/34.2
5,943,777 A * 8/1999 Hosokawa et al. ..... 30/34.2
6,082,005 A * 7/2000 Tezuka ..... 30/43.92
6,205,666 B1 * 3/2001 Junk ..... 30/43.92
6,637,113 B2 * 10/2003 Ikuta et al. ..... 30/43.92
7,302,759 B2 * 12/2007 Oh ..... 30/43.92
2002/0011003 A1 * 1/2002 Van Hout et al. ..... 30/34.1
2002/0083592 A1 * 7/2002 Liao ..... 30/43.92
2006/0137187 A1 * 6/2006 Fukutani et al. ..... 30/43.92

* cited by examiner

*Primary Examiner*—Hwei-Siu C Payer
(74) *Attorney, Agent, or Firm*—Cantor Colburn LLP

(57) ABSTRACT

A head moving type electric razor includes an upper cap mounted on a housing and having holding protrusions formed at left and right inner surfaces thereof, a head support having left and right walls, pivot supporting recesses, lower coupling grips formed at outer surfaces of the respective walls, and hooks caught by the holding protrusions, a waterproof rubber plate mounted in the housing, a guide plate mounted in the upper cap and having an elongated center guide hole, a vibrator slidably coupled into the guide hole and having an upper coupling pin and a lower clevis recess, an eccentric shaft slidably coupled into the clevis recess, a swing head having pivots fitted into the pivot supporting recesses, upper coupling grips, and an arcuate trimmer drive slot, and a locking knob coupled to the upper cap and having a latch detachably coupled to the swing head.

2 Claims, 5 Drawing Sheets

HEAD MOVING TYPE ELECTRIC RAZOR

BACKGROUND OF THE INVENTION

1. Field of the Invention

The present invention relates to a head moving type electric razor, and more particularly, to a head moving type electric razor in which a swing head and a head support can be separated more easily from a housing.

2. Description of the Related Art

Generally, electric razors are classified into a trimmer type electric razor designed to shave the beard with a reciprocating trimmer, and a rotary type electric razor designed to shave the beard with a rotating razor blade. More particularly, in the trimmer type electric razor, the trimmer is operated by a device that converts rotating motion energy generated from a motor into rectilinear reciprocating motion energy, so as to cut the beard introduced into the razor through the mesh of a screen installed to a razor head.

Recently, a head moving type electric razor has been developed and used. The head moving type electric razor employs a swing head adapted to rotate along the curved contours of the face and allows a user to smoothly perform a shaving operation while keeping his wrist in a stationary state.

However, the above described conventional head moving type electric razor has a problem in that the swing head cannot be separated from a housing. This makes it difficult to clearly remove cut beard, etc. remained inside the head, thus leaving the electric razor in an insanitary state. Also, the conventional head moving type electric razor suffers from a complicated product structure because it requires a careful attention in the waterproofing of a product in order to prevent invasion of water into the housing during the washing of the electric razor. Furthermore, it has been found that a waterproof structure employed in the above described type of electric razor tends to be damaged after being used for a long time, thus causing a breakdown of the electric razor due to the invasion of water.

SUMMARY OF THE INVENTION

Therefore, the present invention has been made in view of the above problems, and it is an object of the present invention to provide a head moving type electric razor in which a swing head can be easily separated from a housing.

In accordance with the present invention, the above and other objects can be accomplished by the provision of a head moving type electric razor comprising: an upper cap mounted at an upper end of a housing, the upper cap having holding protrusions formed at left and right inner surfaces thereof; a head support having left and right walls, pivot supporting recesses centrally dented at upper ends of the walls, respectively, lower coupling grips formed at outer surfaces of the respective walls, and hooks formed below the lower coupling grips, respectively, the hooks being configured to be caught by the holding protrusions of the upper cap; a waterproof rubber plate mounted in the center of the upper end of the housing, the waterproof rubber plate having a center hole and a corrugated portion; a guide plate mounted in the upper cap, the guide plate having an elongated center guide hole; a vibrator slidably coupled into the elongated guide hole of the guide plate, the vibrator having a coupling pin formed at an upper end thereof and a clevis recess formed in a lower end thereof, as an eccentric shaft coupled to a motor is slidably coupled into the clevis recess, the vibrator being adapted to perform a leftward and rightward reciprocating motion; a swing head having pivots configured to be fitted into and supported by the pivot supporting recesses of the head support, upper coupling grips formed at left and right outer surfaces thereof, and an arcuate trimmer drive slot perforated in the bottom thereof for allowing the coupling pin of the vibrator to be slidably coupled thereinto; and a locking knob coupled to the upper cap through an elongated knob guiding slot perforated in the upper cap to thereby be slidable leftward and rightward, the locking knob having a latch configured to be detachably coupled into a holding groove formed at a lower surface of the swing head.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Now, preferred embodiments of the present invention will be described in detail with reference to the accompanying drawings.

Figure 1:
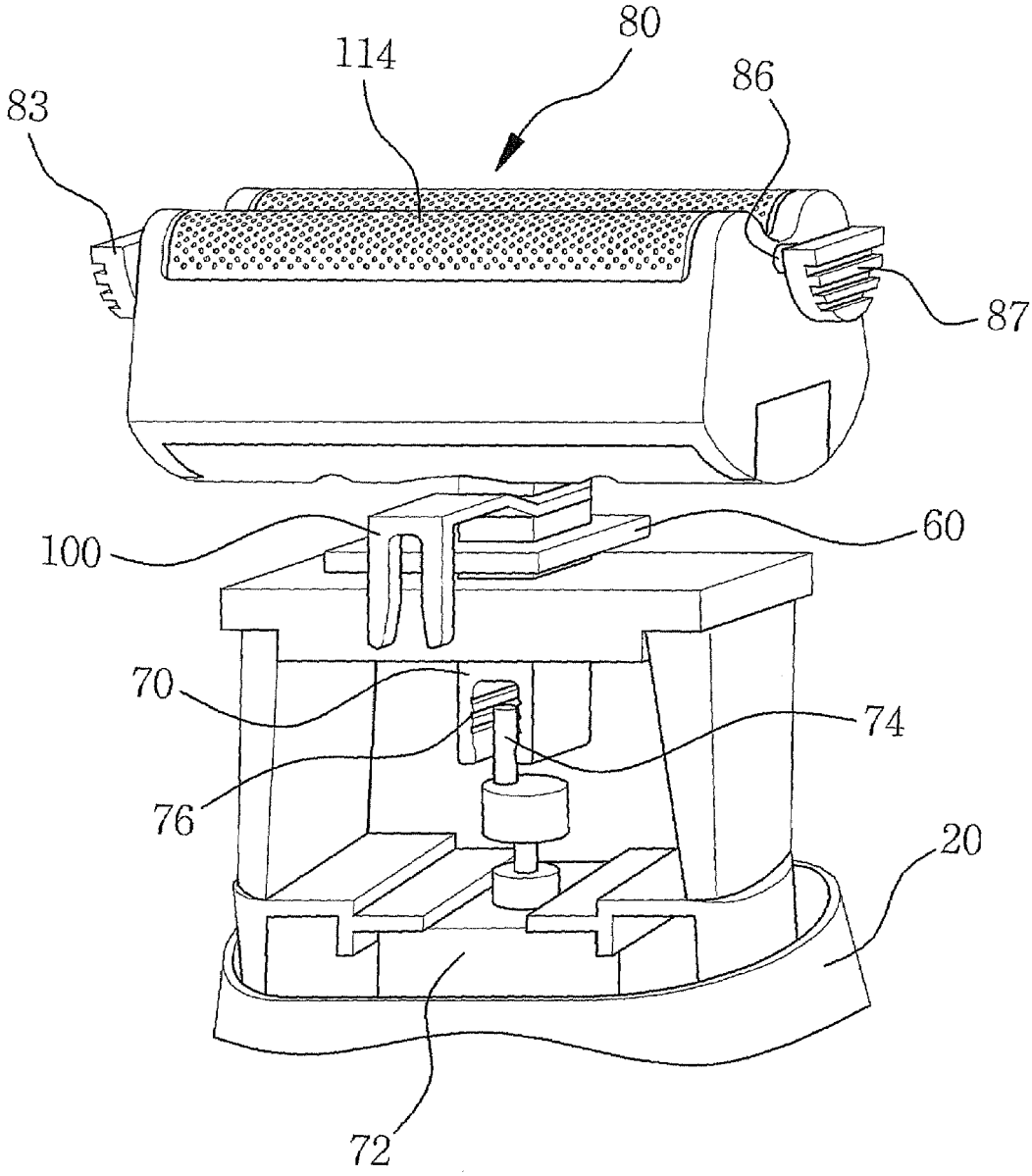
FIG. 1 is a perspective view illustrating a swing head according to the present invention.
Figure 2:
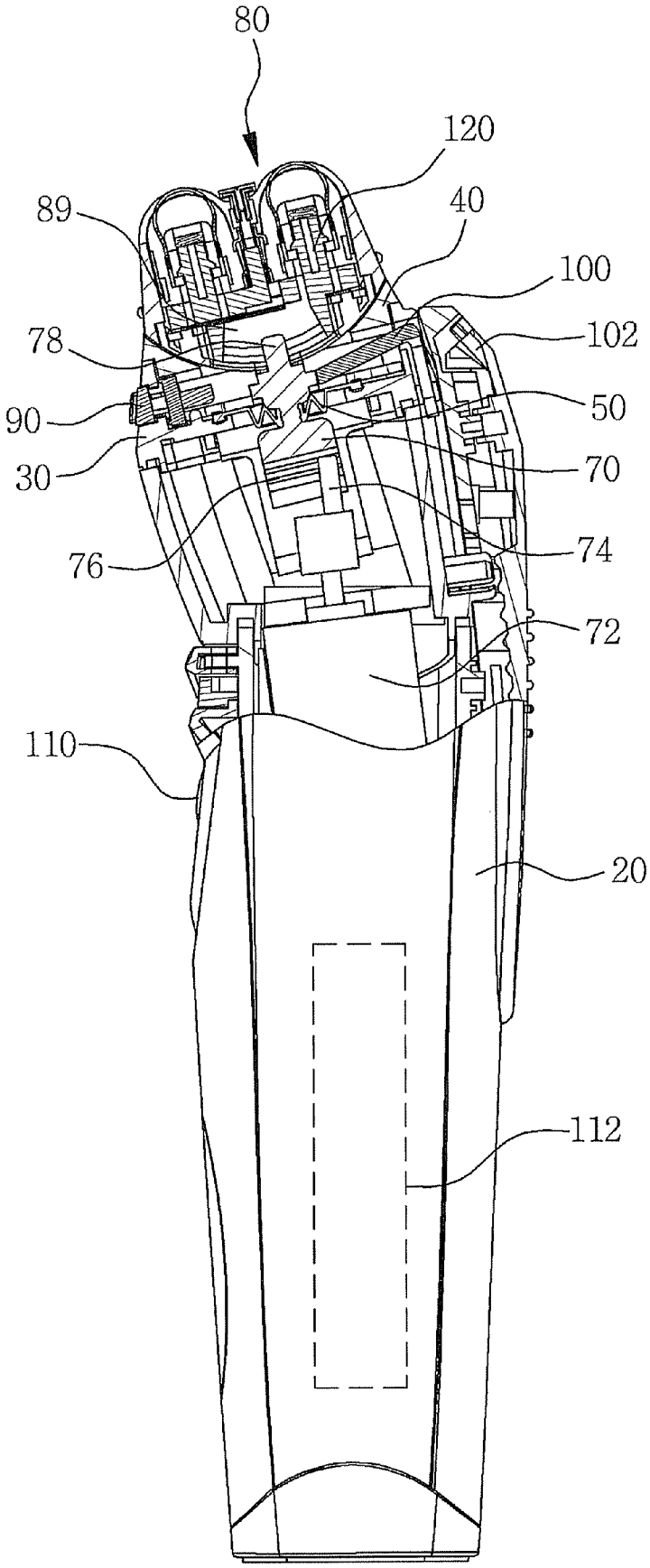
FIG. 2 is a side sectional view illustrating a head moving type electric razor according to the present invention.
Figure 3:
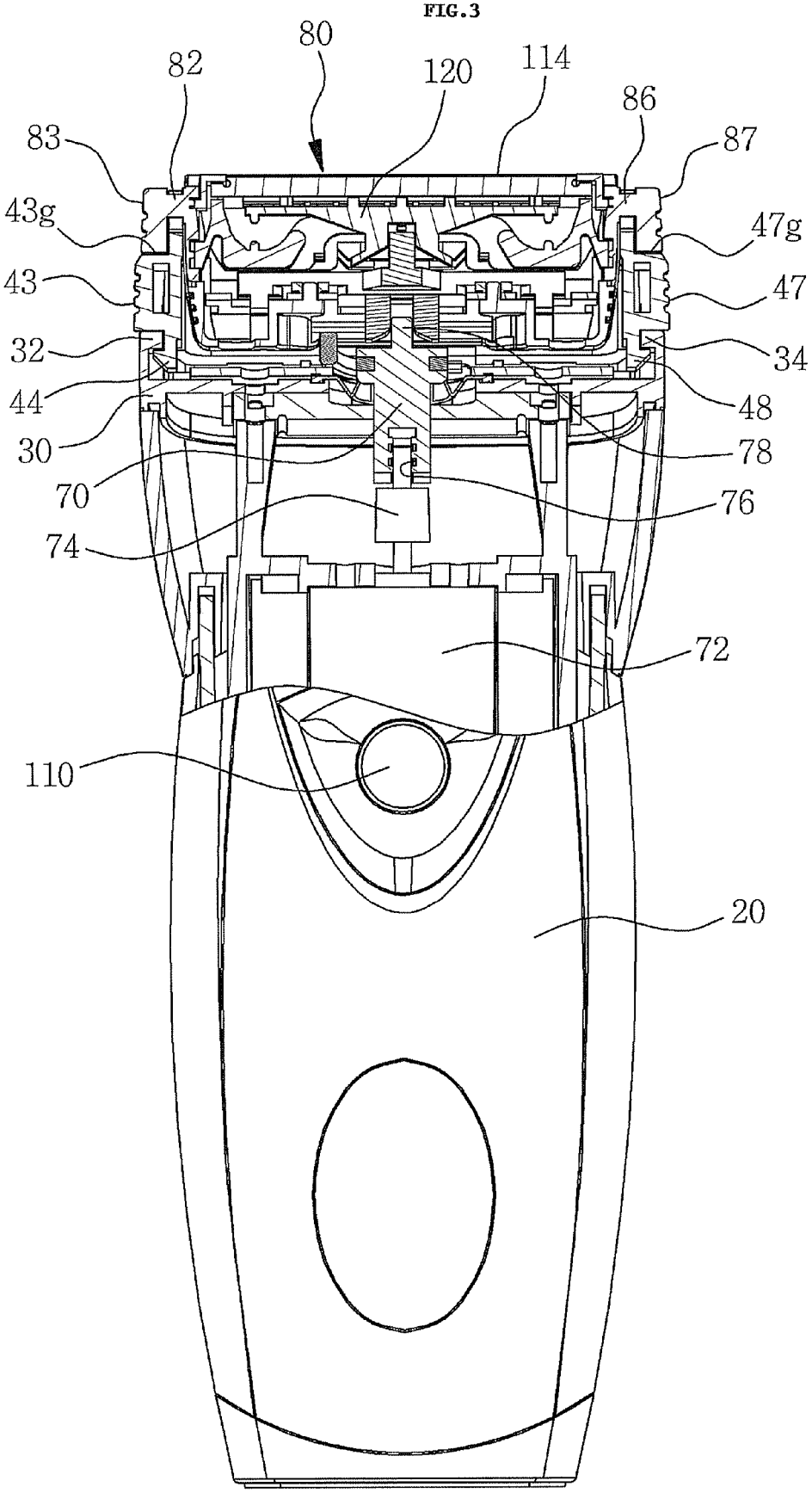
FIG. 3 is a front sectional view of the head moving type electric razor according to the present invention.
Figure 4:
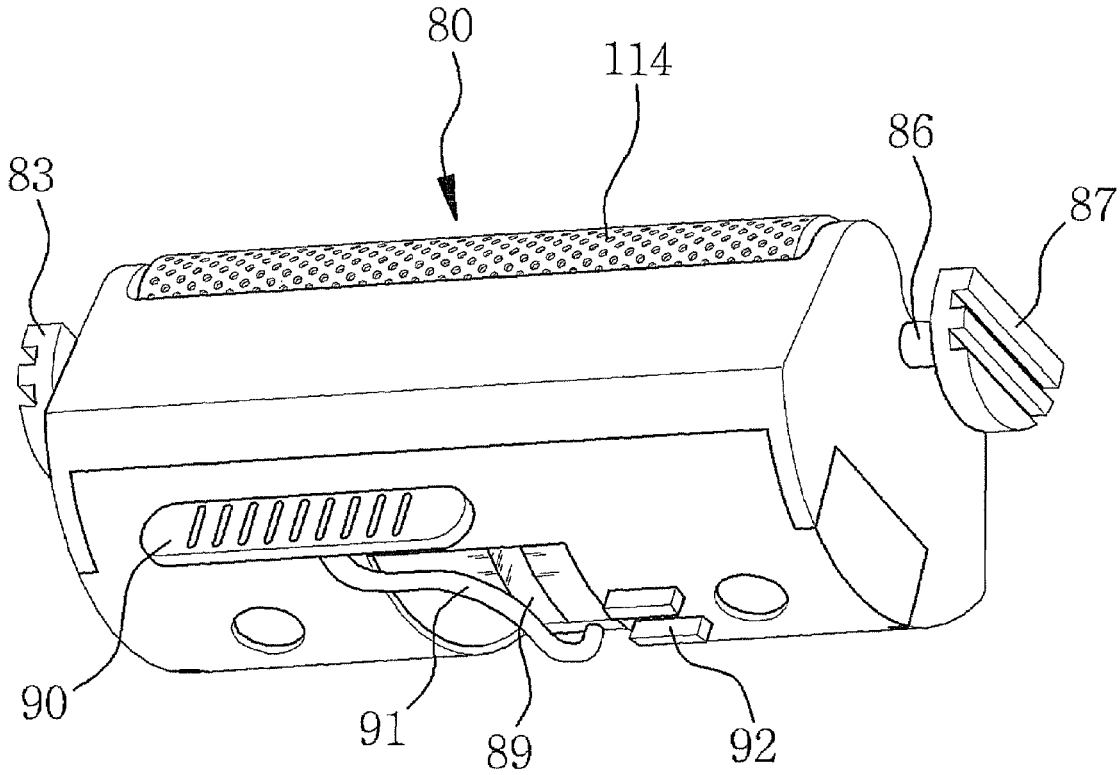
FIG. 4 is a bottom perspective view illustrating a swing head and a locking knob according to the present invention.
Figure 5:
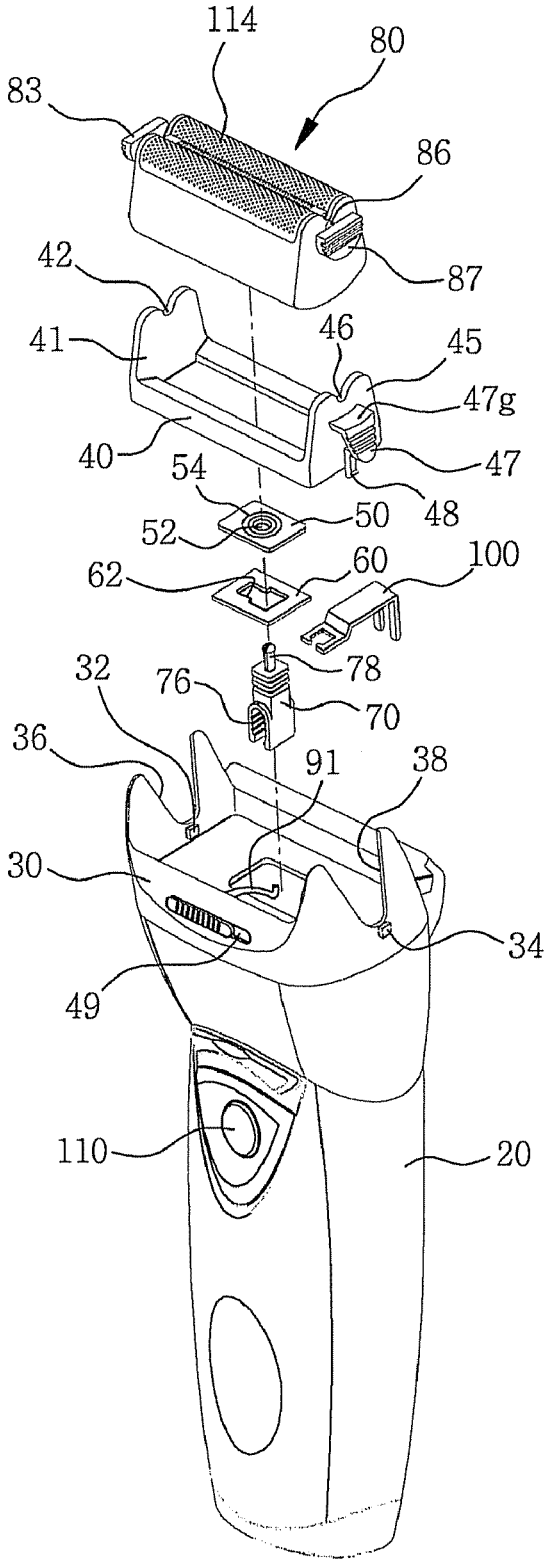
FIG. 5 is an exploded perspective view of the head moving type electric razor according to the present invention.

As shown in FIGS. 1 to 5, a head moving type electric razor according to the present invention generally comprises a housing 20, an upper cap 30, a head support 40, a waterproof rubber plate 50, a guide plate 60, a vibrator 70, a swing head 80, and a locking knob 90. More particularly, the upper cap 30 is mounted at an upper end of the housing 20 and has holding protrusions 32 and 34 formed at left and right inner surfaces thereof. The head support 40 has left and right walls 41 and 45, pivot supporting recesses 42 and 46 centrally dented at upper ends of the walls 41 and 45, respectively, lower coupling grips 43 and 47 formed at outer surfaces of the respective walls 41 and 45, and hooks 44 and 48 formed below the grips 43 and 47, respectively, the hooks 44 and 48 being configured to be caught by the holding protrusions 32 and 34 of the upper cap 30. The waterproof rubber plate 50 is mounted in the center of the upper end of the housing 20 and has a center hole 52 and a corrugated portion 54. The guide plate 60 is mounted in the upper cap 30 and has an elongated center guide hole 62. The vibrator 70 is slidably coupled into the elongated guide hole 62 of the guide plate 60. The vibrator 70 has a coupling pin 78 formed at an upper end thereof and a clevis recess 76 formed in a lower end thereof. As an eccentric shaft 74 coupled to a motor 72 is slidably coupled into the clevis recess 76, the vibrator 70 is adapted to perform a leftward and rightward reciprocating motion. The swing head 80 has pivots 82 and 86 configured to be fitted into and supported by the pivot supporting recesses 42 and 46 of the head support 40, upper coupling grips 83 and 87 formed at left and right outer surfaces thereof, and an arcuate trimmer drive slot 89 perforated in the bottom thereof for allowing the coupling pin 78 of the vibrator 70 to be slidably coupled thereinto. The locking knob 90 is coupled to the upper cap 30 through an elongated knob guiding slot 49 perforated in the upper cap 30 so that it is slidable leftward and rightward. The locking knob 90 has a latch 91 configured to be detachably coupled into a holding groove 92 formed at a lower surface of the swing head 80.

The upper cap 30 further has "V"-shaped recesses 36 and 38 cut away from left and right upper ends thereof so that the "V"-shaped lower coupling grips 43 and 47 of the head support 40 and the "V"-shaped upper coupling grips 83 and 87 of the swing head 80 are sequentially inserted into the "V"-shaped recesses 36 and 38. The lower coupling grips 43 and 47 of the head support 40 have arcuately-recessed seating planes 43*g* and 47*g*, respectively, so that the upper coupling grips 83 and 87 of the swing head 80 are placed on the respective seating planes 43*g* and 47*g*.

The pivot supporting recesses 42 and 46 have an upwardly-opened "C"-shaped form, and the cut-away portions of the recesses 42 and 46 have a width slightly smaller than a diameter of the pivots 82 and 86. With this configuration, when the pivots 82 and 86 are inserted from the top to the bottom of the pivot supporting recesses 42 and 46, the pivots 82 and 86 are first elastically deformed to enter the pivot supporting recesses 42 and 46 and then, are tightly caught in the pivot supporting recesses 42 and 46 so as not to be unintentionally separated from the recesses 42 and 46 so long as no external force is applied thereto.

The clevis recess 76 of the vibrator 70 has a concave and convex inner surface having grooves extending horizontally from the front side to the rear side of the vibrator 70. The concave and convex configuration reduces a contact area between the clevis recess 76 of the vibrator 70 and the eccentric shaft 74, thereby reducing the loss of power due to friction, enabling a smooth movement of the vibrator 70, and providing a space for receiving lubricating grease introduced into the electric razor.

The locking knob 90 has the latch 91 formed at a rear surface thereof to be caught by the holding groove 92 formed at the lower surface of the swing head 80. Here, the holding groove 92 is defined by two elongated bars protruded from the lower surface of the swing head 80.

The vibrator 70 is formed, at a neck portion thereof, with a recess so that an inverted "L"-shaped clamper 100 is fitted into the neck recess for the transmission of power to side trimmers 102 located behind the vibrator 70.

In the accompanying drawings, not described reference number "110" represents a power switch, reference number "112" represents a battery received in the housing 20, reference number "114" represents a screen installed to the swing head 80, and reference number "120" represents a trimmer unit.

Hereinafter, the operation and effects of the present invention will be described in detail with reference to the accompanying drawings.

As shown in FIGS. 1 to 5, if the power switch 110 provided at the housing 20 is pushed to close a switch contact, electric current flows from the battery 112 to the motor 72 through the power switch 110.

Thereby, as the motor 72 is rotated and simultaneously, the eccentric shaft 74 connected to a shaft of the motor 72 is rotated, the vibrator 70, which is slidably coupled to the eccentric shaft 74, is reciprocally moved leftward and rightward by the eccentric shaft 74. In this case, the leftward and rightward reciprocating motion of the vibrator 70 is rectilinearly guided by the guide plate 60 that is mounted in the head support 40.

The reciprocating motion power of the vibrator 70 is transmitted to the trimmer unit 120 received in the swing head 80 through the trimmer drive slot 89 perforated in the swing head 80. Thereby, when cut beard, etc. is introduced into the swing head 80 through the mesh of the screen 114, the trimmer unit 120 is operated to secondarily cut the beard.

In this case, if the locking knob 90 coupled to the upper cap 30 through the elongated knob guiding slot 49 of the upper cap 30 is switched into a locked state, the latch 91 of the locking knob 90 is caught by the holding groove 92 formed at the lower surface of the swing head 80, thereby acting to prevent rotation of the swing head 80. Accordingly, a shaving operation can be performed in a stationary state of the swing head 80.

On the other hand, if the locking knob 90 is slidably moved to an unlocking position thereof, the latch 91 of the locking knob 90 is released from the holding groove 92 of the swing head 80, thereby acting to allow the swing head 80 to pivotally rotate about the pivots 82 and 86. Accordingly, the swing head 80 is able to freely rotate along the curved contours of the face during a shaving operation, resulting in a smooth shaving operation.

In the course that the power is transmitted from the motor 72 to the trimmer unit 120 received in the swing head 80 during the rotation of the swing head 80, due to the fact that the trimmer drive slot 89 is perforated in the swing head 80 to have an elongated arcuate form extending forward and backward about the pivots 82 and 86, the pivotal rotation of the swing head 80 is not interfered by the coupling pin 78 formed at the upper end of the vibrator 70 and consequently, but leftward and rightward movements of the swing head 80 are restricted by the trimmer drive slot 89.

Meanwhile, to wash the swing head 80 after completing a shaving operation so as to remove the cut beard remained in the swing head 80, first, the upper coupling grips 83 and 87, formed at the left and right sides of the swing head 80, are pulled upward by the user's fingers. Thereby, the pivots 82 and 86, formed at the left and right sides of the swing head 80, are released from the pivot supporting recesses 42 and 46 of the head support 40 and simultaneously, the coupling pin 78, formed at the upper end of the vibrator 70, is released from the trimmer drive slot 89. In this way, the swing head 80 is separated from the housing 20.

Next, if the lower coupling grips 43 and 47, formed at the left and right sides of the head support 40, are pushed downward by the user's fingers, the hooks 44 and 48, which are located below the lower coupling grips 43 and 47, are bent and released from the holding protrusions 32 and 34 of the upper cap 30. Then, if the lower coupling grips 43 and 47 are pulled upward, the head support 40 is separated from the housing 20.

Accordingly, the swing head 80, separated from the housing 20, is able to be immersed in water for the sake of washing thereof. As the swing head 80 is shaken and inverted in water, the cut beard remained in the swing head 80 can be clearly removed. In this case, the housing 20, which is separated from the swing head 80, has no risk of invasion of water.

Thereafter, to couple the swing head 80 and the head support 40 to the housing 20, first, the lower coupling grips 43 and 47, formed at the left and right sides of the head support 40, are aligned with the "V"-shaped recesses 36 and 38 formed in the left and right portions of the upper cap 30 so that the head support 40 is inserted into the upper cap 30. Thereby, the hooks 44 and 48, formed at the left and right sides of the head support 40, are caught by the holding protrusions 32 and 34 inside the upper cap 30. As a result, the lower coupling grips 43 and 47 are positioned in the "V"-shaped recesses 36 and 38 formed in the left and right portions of the upper cap 30 as they are fitted in the recesses 36 and 38 in a wedge manner.

Subsequently, if the upper coupling grips 83 and 87, formed at the left and right sides of the swing head 80, are manually inserted into the head support 40 from the upper side of the head support 40, the pivots 82 and 86, formed at the left and right sides of the swing head 80, are fitted into the pivot supporting recesses 42 and 46 formed at the upper ends of the walls 41 and 45 of the head support 40. Simultaneously, the coupling pin 78 of the vibrator 70, which is exposed upward from the upper end of the housing 20 at the center of the upper end, is inserted into the trimmer drive slot 89 perforated in the bottom of the swing head 80. In this way, the coupling of the head support 40 and the swing head 80 is completed.

In this case, even if moisture remains in the head support 40 and the swing head 80, according to the present invention, the waterproof rubber plate 50 is located between the housing 20 and the vibrator 70 and serves to prevent the invasion of moisture into the housing 20. Furthermore, the corrugated portion 54 formed at the waterproof rubber plate 50 is able to be folded when the vibrator 70 vibrates leftward and rightward, and this has the effect of reducing a resistance applied to the vibrator 70 by the waterproof rubber plate 50, resulting in a reduction in the loss of power.

Also, with the use of the inverted "L"-shaped clamper 100 coupled to the neck portion of the vibrator 70, the motion energy of the vibrator 70 is able to be transmitted to the side trimmers 102. In this case, if the side trimmers 102 are designed to be spread, the side trimmers 102 may be utilized in the trimming of relatively long beard.

As apparent from the above description, according to the present invention, the swing head and the head support can be separated from the housing. Accordingly, the swing head and the head support can be washed individually, so as to clearly remove beard, etc. remained therein in a sanitary manner.

Furthermore, according to the present invention, with the use of the lower coupling grips formed at the head support and the upper coupling grips formed at the swing head, the swing head and the head support can be more easily separated from the housing. Similarly, to couple the head support and the swing head to the housing, the lower coupling grips and the upper coupling grips are sequentially fitted into the "V"-shaped recesses formed at the upper cap for the positioning of the head support and the swing head. This has the effect of achieving a stronger coupling between the head support and the swing head. Moreover, the upper coupling grips are placed on the arcuately-recessed seating planes formed at the upper ends of the lower coupling grips, and this has the effect of achieving an improvement in the accuracy of positioning between the swing head and the head support. Also, by virtue of the fact that the trimmer drive slot of the swing head is arcuately formed about the pivots, the swing head is able to maintain a predetermined number of contact points with the eccentric shaft of the motor. This has the effect of minimizing the change of load depending on a change in the angle of the swing head, and enabling a smooth shaving operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A head moving type electric razor comprising:

an upper cap mounted at an upper end of a housing, the upper cap having holding protrusions formed at left and right inner surfaces thereof;

a head support having left and right walls, pivot supporting recesses centrally dented at upper ends of the walls, respectively, lower coupling grips formed at outer surfaces of the respective walls, and hooks formed below the lower coupling grips, respectively, the hooks being configured to be caught by the holding protrusions of the upper cap;

a waterproof rubber plate mounted in the center of the upper end of the housing, the waterproof rubber plate having a center hole and a corrugated portion;

a guide plate mounted in the upper cap, the guide plate having an elongated center guide hole;

a vibrator slidably coupled into the elongated guide hole of the guide plate, the vibrator having a coupling pin formed at an upper end thereof and a clevis recess formed in a lower end thereof, as an eccentric shaft coupled to a motor is slidably coupled into the clevis recess, the vibrator being adapted to perform a leftward and rightward reciprocating motion;

a swing head having pivots configured to be fitted into and supported by the pivot supporting recesses of the head support, upper coupling grips formed at left and right outer surfaces thereof, and an arcuate trimmer drive slot perforated in the bottom thereof for allowing the coupling pin of the vibrator to be slidably coupled thereinto; and a locking knob coupled to the upper cap through an elongated knob guiding slot perforated in the upper cap to thereby be slidable leftward and rightward, the locking knob having a latch configured to be detachably coupled into a holding groove formed at a lower surface of the swing head.

2. The electric razor according to claim 1, wherein the upper cap further has "V"-shaped recesses cut away from left and right upper ends thereof, to allow the lower coupling grips of the head support and the upper coupling grips of the swing head to be sequentially inserted into the "V"-shaped recesses, and the lower coupling grips of the head support have arcuately-recessed seating planes, respectively, to allow the upper coupling grips of the swing head to be placed on the respective seating planes.

* * * * *